US005285804A

United States Patent [19]

Gretzmacher

[11] Patent Number: 5,285,804

[45] Date of Patent: Feb. 15, 1994

[54] FOLDABLE DUMMY OBJECT FOR CAMOUFLAGE PURPOSES

[75] Inventor: Floris Gretzmacher, Vienna, Austria

[73] Assignee: Barracuda Technologies AB, Sweden

[21] Appl. No.: 994,773

[22] Filed: Dec. 22, 1992

Related U.S. Application Data

[63] Continuation-in-part of Ser. No. 646,639, May 11, 1990, Pat. No. 5,238,015.

[30] Foreign Application Priority Data

May 31, 1989 [AT] Austria ..... 1308/89

[51] Int. Cl.[5] ..... E04H 15/40

[52] U.S. Cl. ..... 135/104; 135/95; 24/122.6

[58] Field of Search ..... 135/98, 104, 102, 95, 135/905; 24/122.6

[56] References Cited

U.S. PATENT DOCUMENTS

| | | | |
|---|---|---|---|
| 783,631 | 2/1905 | Greger | 24/122.6 |
| 1,261,036 | 4/1918 | Kerns | 24/122.6 |
| 1,349,281 | 8/1920 | King | 135/19.5 |
| 2,475,515 | 7/1949 | Potter | 135/104 |
| 2,608,198 | 8/1952 | Goodman | 135/104 |
| 2,808,846 | 10/1957 | Jonsson | 135/98 |
| 3,213,868 | 10/1965 | Forbes | 35/98 |
| 4,021,974 | 5/1977 | Edwards | 135/104 |
| 4,154,254 | 5/1979 | Spenser | 135/104 |

FOREIGN PATENT DOCUMENTS

| | | | |
|---|---|---|---|
| 248034 | 11/1963 | Australia | 135/98 |

*Primary Examiner*—Henry E. Raduazo

*Attorney, Agent, or Firm*—Feiereisen & Kueffner

[57] ABSTRACT

A camouflage device adapted to fold and unfold and to assume the shape of a dummy object when in the unfolded configuration for camouflaging an object, includes a frame for supporting a camouflage netting, with the frame being adaptable for displaying irregular configuration and including flexible rod structures having one end detachably secured to a crown member and another end adapted for placement upon a suitable location of the object to be camouflaged. Each of the rod structures is made of an elastic band of fiber-reinforced plastic material or steel to allow flexible configuration and random shaping of the frame.

10 Claims, 3 Drawing Sheets

FOLDABLE DUMMY OBJECT FOR CAMOUFLAGE PURPOSES

CROSS-REFERENCES TO RELATED APPLICATIONS

This is a continuation-in-part of pending patent application Ser. No. 07/646,639, filed May 11, 1990 and now U.S. Pat. No. 5,238,015.

BACKGROUND OF THE INVENTION

The invention refers to a camouflage device in form of foldable irregular dummy objects which are distributed upon and attached to an object to be camouflaged, for preventing identification of the object by the naked eye, optical sensors or computer-aided optical sensors.

Known devices of this kind include support structures with a camouflage netting which can be attached to the military object or which can be tilted to assume the intended position (DE 3501611 A1 and DE 2558371 C2, CH 594867). Although easily identifiable contours of the military object become obscured, the overall dimension of the object to be camouflaged significantly increases. Also, the camouflage netting sags wherever it is not supported, resulting in concave surfaces which do not exist in nature. Whenever these concave surfaces exhibit any gloss (or shimmer), a focusing in focal points at greater distances of the object to be camouflaged can be encountered (in accordance with the principle of a concave mirror). A sagging of larger areas can only slightly be reduced by extending the ends of the support structures of the camouflage netting by means of conventional dish-shaped support elements or by specially designed additional rod assemblies (U.S. Pat. No. 4,441,518). Objects of great dimensions (e.g. trucks or artillery pieces), usually require large areas of same material (camouflage netting) which include further elements like branches, twigs, or the like to achieve a sufficient level of camouflage.

For certain specific objects, like artillery pieces, devices are available that can either cover the artillery piece or be opened to expose it (CH 606972). Such devices yield three-dimensional objects which are enveloped by the camouflage netting; however, since their design is greatly dependent on the regular shape of the military object, the selection of shapes for these camouflage nettings is limited. When opened, this device is less effective for camouflage than in its closed position.

SUMMARY OF THE INVENTION

It is an object of the present invention to provide an improved camouflage device which can be swiftly attached and detached and attains a minimum increase in surface and volume of the military object while yet considerably reducing the visibility thereof.

This object and others which will become apparent hereinafter is attained in accordance with the present invention by providing a frame for supporting a camouflage netting, with the frame including a support member and flexible rod structures having one end detachably secured to the support member and another end adapted for placement upon a suitable location of the object to be camouflaged, wherein each of the rod structures is made of a single continuous elastic band attached to the support member to allow flexible configuration and random shaping of the frame.

In this manner, the frame may display an irregular three-dimensional configuration over which a camouflage netting is stretched and which may be positioned over the corners and edges of the object.

The elastic band may be made of fiber-reinforced plastic material or steel so as have sufficient inherent stiffness to prevent a collapse of the frame but yet allowing random shaping of the frame. Preferably, the frame is stiffened through tension in direction of the object by a rope which is affixed with one end to a suitable point of attachment of the object and selectively secured to the support member to adjust the length of the rope for avoiding a slack of the rope between the support member and the point of attachment on the object being camouflaged. The rope is preferably comprised of two strands which are intertwined at regular intervals so as to have a number of successive holes which are selectively affixed to a knob of the support member.

According to a further feature of the present invention, the attachment of the rope to the support member may be achieved by providing the support member with a central hole, with the knob being disposed at the outside of the support plate near the hole.

Through the provision of such a frame, the camouflage device can be rapidly and reproducibly assembled and disassembled.

The camouflage device according to the invention permits utilization not only of contrasts of color and brightness, but also of natural shades caused by the dummy objects in the visible spectral range and reflective properties in the other ranges usable for optical purposes (e.g. ultra-violet, infra-red, microwaves, and millimeter waves).

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
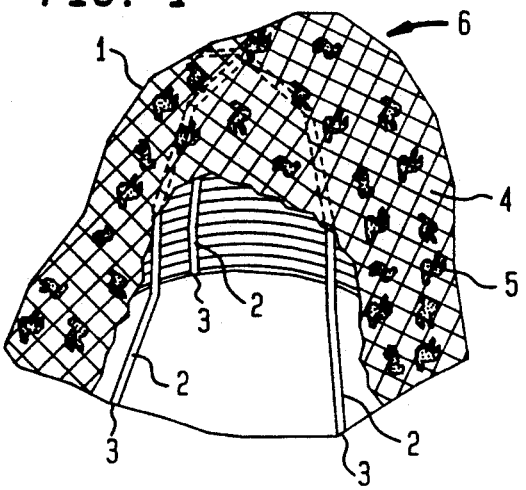
FIG. 1 is a schematic, partly broken away, perspective illustration of one embodiment of a camouflage device in accordance with the present invention.

Referring now to the drawing, and in particular to FIG. 1, there is shown a schematic, partly broken away, perspective illustration of one embodiment of a camouflage device in accordance with the present invention, generally designated by reference numeral 6. The frame of the camouflage device 6 includes at least three irregularly shaped rod structures 2, with their one ends being connected to each other in a common juncture 1, and with their other free ends 3 being placeable upon an object 7 (FIG. 2) to be camouflaged. A camouflage canvas or netting 4 is attached over the frame, and additional material 5 such as branches, twigs or the like is further affixed to the camouflage netting 4 for enhancing the camouflage effect.

Figure 2:
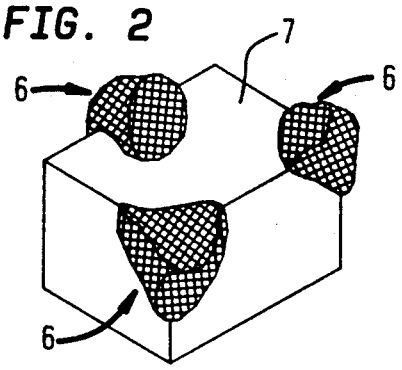
FIG. 2 is a schematic illustration of various camouflage devices suitably mounted to an exemplified object to be camouflaged.
Figure 3:
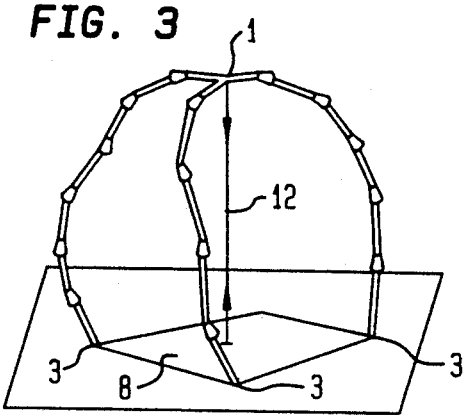
FIG. 3 is a schematic illustration of a camouflage device according to the invention, provided with a stiffening element for retaining the frame of the camouflage device according to the invention in place.

FIG. 2 illustrates an example of camouflaging an object 7 by using a plurality of camouflage devices 6. The object 7 is obscured by three camouflage devices 6 which are placed at selected areas of the object 7, for example at the corners or at a central area to give the object 7 an uneven appearance. In order to improve the hold of the frame upon the object 7, the free ends 3 of the rod structures 2 may be connected, as shown in FIG. 3, by a flexible backing 8 which may be a string structure of star-shaped or polygonal configuration, and/or by a flexible string 12 by which a tensile load is exerted in direction of the object 8.

Figure 4:
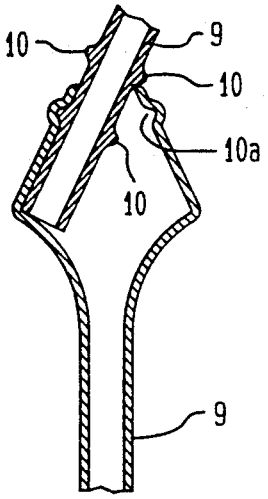
FIG. 4 is a schematic and fragmentary sectional view of exemplified rod segments suitably connected for forming the frame of the camouflage device.

Turning now to FIG. 4, there is shown a schematic and fragmentary sectional view of individual rod links or segments 9 which are joined or articulated to each other to create the rod structures 2 and to allow a random selection of irregular shapes of the frame. Each rod segment 9 is of elongated tubular configuration, with one extremity being expanded and approximately shaped in form of a diamond with open end and with the other extremity being provided with successively spaced pairs of semi-circular projections or bulges 10. At a suitable location, the diamond-shaped end of each rod segment 9 is provided with two opposing inside indentations 10*a* which are selectively engageable by either one of the projections 10 of another rod segment 9 to be attached. In this manner, the rod segments 2 to be attached can be moved back and forth in form of a flip-flop arrangement between two end positions to provide the rod structures 2 with irregular configuration.

Suitably, the diamond-shaped end of the rod segments 9 and the distance between the pairs of projections 10 are dimensioned in such a manner that upon connection of two rod segments 9 through engagement of a projection 10 in the corresponding indentation 10*a*, one projection of the upper pair of one rod segment 9 is supported by the open end of the other rod segment 9. Thus, the rod segments 9 are linked to each other in a tight and form-locking manner.

Figure 5:
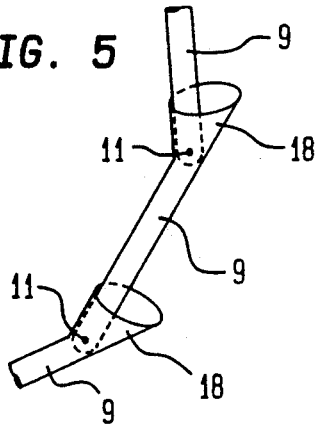
FIG. 5 is a schematic and fragmentary illustration of a variation of a hinged connection of exemplified rod segments of a camouflage device according to the invention.

FIG. 5 shows a schematic illustration of another example of a flip-flop connection of individual rod segments 9, and it can be seen that each rod segment 9 has one funnel-shaped end 18 to which the other end of a further rod segment 9 is suitably articulated so as to allow a relative rotational motion between the rod segments 9 about an axis of rotation 11. Suitably, each rod segment 9 extends slantingly from the funnel-shaped end 18 so that the axes of rotation 11 of successively linked rod segments 9 are offset relative to each other to allow different positioning of the rod segments 9 and to obtain an overall irregular shape of the camouflage device 6 when attaching a netting 4 thereto.

Persons skilled in the arts will understand that the individual rod segments 9 can be attached and held together by other means as well, for example by an elastic rubber band which is attached to the inside surface of the rod segments 9. Moreover, the individual rod segments may be made of suitably elastic or flexible material to allow deformation of each rod segment 9 to further increase the irregular appearance of rod structures 2.

Figure 6:
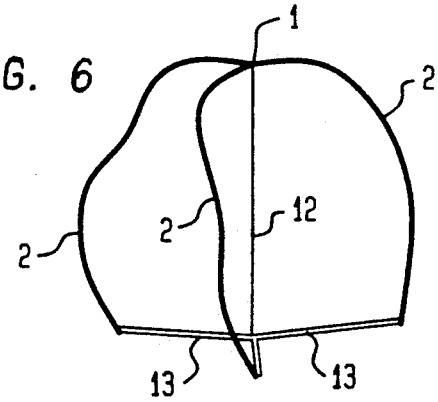
FIG. 6 is a schematic view of a frame of a camouflage device according to the invention, provided with an exemplified stretcher means for allowing upward folding of the camouflage device.

Turning now to FIG. 6, there is shown a frame of rod structures 2 which is stiffened or made firmer by the elastic band or string 12 in order to improve the stability of the camouflage device 6. As set forth with reference to FIG. 3, the string 12 has one end attached to the common juncture 1 in which the rod structures 2 meet with their one ends, and extends toward the object 7 (not shown in FIG. 6) to exert a tensile load in direction of the object 7. In this manner, the camouflage device 6 is securely held in place upon the object 7. The free ends 3 of the rod structures 2 are further connected by a suitable stretcher device in form of star-shaped struts 13 to allow folding and unfolding of the frame. Certainly, more complex strutting elements may be utilized, such as those used in umbrellas.

Figure 7:
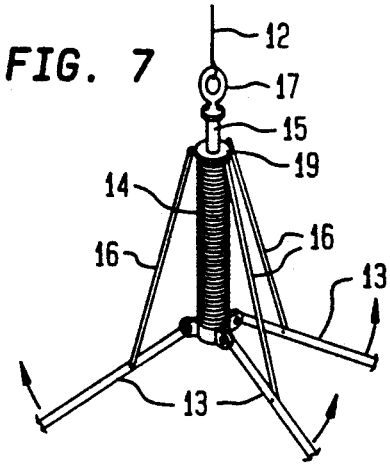
FIG. 7 is a schematic illustration of a spring-loaded mechanism for automatic folding and unfolding of a camouflage device according to the invention.

A typical example of an automatic stretcher device is shown in FIG. 7 which depicts an exemplary spring-loaded mechanism for automatic folding and unfolding of the struts 13 of the camouflage device 6 according to the invention. This mechanism includes a rigid guide bar 15 upon which an annular slide 19 slides. Hingedly connected to the slide 19 are the one ends of the struts 16, the other ends of which being respectively hinged to a central location of the struts 13. A compression spring 14 is mounted along the guide bar 15 between the slide 19 and the connection to the struts 13.

The upper end of the guide bar 15 may be provided with an eyelet 17 for attachment of the elastic band 12 to exert a tensile load.

Figure 8:
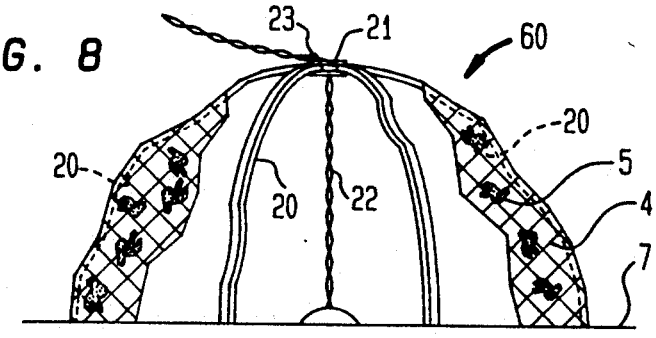
FIG. 8 is a schematic, partly broken away, side view of another embodiment of a camouflage device in accordance with the present invention.

Turning now to FIG. 8, there is shown a schematic, partly broken away, side view of another embodiment of a camouflage device in accordance with the present invention, generally designated by reference numeral 60. The camouflage device 60 includes a frame which comprises three or more flexible or elastic rod structures 20 and a central support or crown member 21 in form of a plate or a disk. Each rod structure 20 is comprised of a single elastic band of fiber-reinforced plastic material such as epoxy resin reinforced by a glass fiber woven fabric, or steel. One end of the each structure 20 is detachably secured to the perimeter of the crown member 21 while the other free end is placeable upon the object 7 being camouflaged. A camouflage canvas or netting 4 is attached over the frame, and additional material 5 such as branches, twigs or the like is further affixed to the camouflage netting 4 for enhancing the camouflage effect.

The camouflage device 60 may have, for example, a diameter of 1.7 m. A larger model may have a diameter of 2.5 m. Persons skilled in the art will understand, however, that the size and shape may vary with the object 7 being camouflaged. Further, it should be readily understood that the attachment of the rod structures 20 to the crown member 21 can be carried out in various ways. For example, the crown member 21 may be of I-shaped configuration, with the respective ends of the rod structures 20 being clamped between the opposing shanks of the crown member 21, as indicated in FIG. 8 by way of example only.

The elastic rod structures 20 are of sufficient stiffness to prevent a collapse of the frame after being positioned over the object 7 and yet is sufficiently bendable or shapable to allow the frame of the camouflage device 60 to display an irregular configuration.

Figure 9:
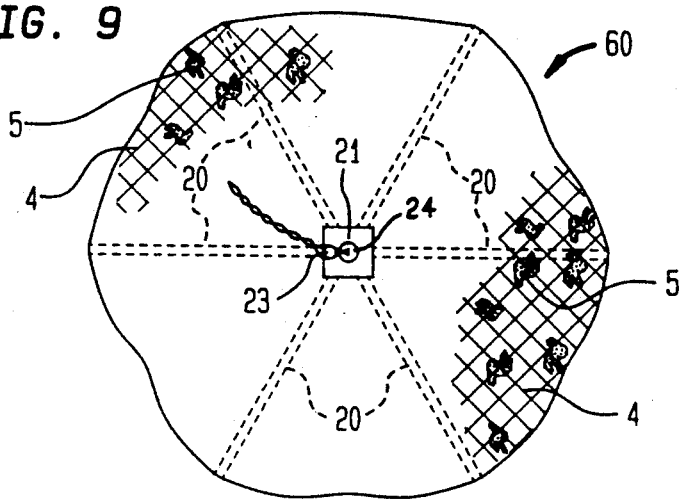
FIG. 9 is a top view of the camouflage device of FIG. 8.

As shown in particular in FIGS. 8 and 9, the crown member 21 is provided with a central throughhole 24 and a knob 23 which is located at the object-distant side of the crown member 21 near the throughhole 24. A rope 22 which is suitably affixed or tied at a random point of attachment to the object 7 (the semicircle is indicated solely for illustrative purposes to represent an exemplified point of attachment) is guided or threaded through the throughhole 24 and attached to the knob 23 in such a manner that the rope 22 is stretched between the crown member 21 and the object 7 to take up any slack, as illustrated in FIG. 8. The rope 22 thus exerts a tensile load in direction of the object 7 being camouflaged and gives the frame of the camouflage device 60 sufficient stability. Moreover, the rope 22 may also be used for changing the configuration of the frame to give it a different appearance as will be described in more detail with reference to FIG. 10.

In order to allow selective attachment and adjustment of its length between the object 7 and the crown member 21, the rope 22 is comprised of two strands which are intertwined to have successive openings, as best seen in FIG. 8. The openings of the rope 22 are of sufficient size to allow easy but yet secure attachment of the rope 22 by slipping it over the knob 23.

When camouflaging an object 7, the frame of the camouflage device 60 is placed with its free ends upon a suitable location of the object 7 and randomly shaped to display an uneven configuration. The rope 22 is then affixed to the object 7 at a suitable point of attachment and guided through the hole 24 of the crown member 21 and attached to the knob 23 without any slack between the crown member 21 and the object 7. In this manner, the rope 22 exerts a tensile force in direction of the object 7 and afford stability to the frame.

Thereafter, a netting 4 is stretched over the frame to complete the camouflage device and to prevent the free ends of the rod structures 20 from shifting outwardly.

Figure 10:
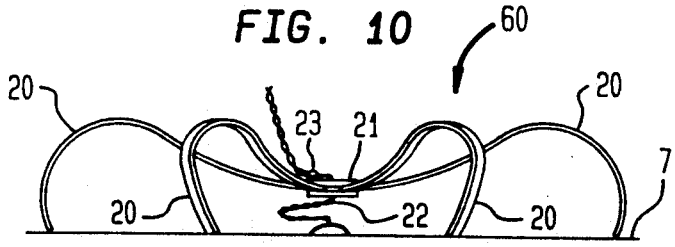
FIG. 10 is a side view of the camouflage device of FIG. 8, showing, an exemplified configuration of the camouflage device.

The flexibility of the rod structures 20 allows a random shaping of the frame suitable for camouflaging the object 7. An exemplified configuration of the camouflage device 60 is illustrated in FIG. 10 in which the frame is shaped to conform with a somewhat "donut"-like flattened configuration. This configuration is created by pulling the rope 22 downwards, e.g. from the position as shown in FIG. 8, while downwardly pushing the crown member 21 from the outside until the crown member 21 reaches about the point of attachment of the rope 22 to the object 7. The length of the loose rope 22 between the crown member 21 and the object 7 is then readjusted to take up any slack by tightening the rope 22 and affixing it to the knob 23 via the appropriate opening.

Figure 11:
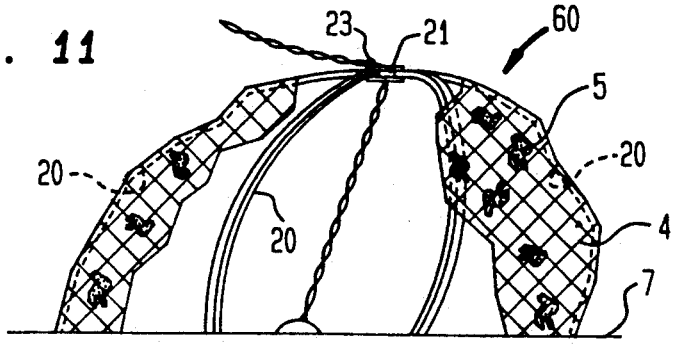
FIG. 11 is a side view of the camouflage device of FIG. 8, showing another exemplified configuration of the camouflage device with asymmetric placement of the frame upon an object, being camouflaged.

FIG. 11 shows a variation of positioning and configuring the camouflage device 60 by using the rope 22. In this position, the rope 22 is affixed to the object 7 such that the rope 22 extends slantingly so that the free ends of the rod structures 20 extend asymmetrically to the crown member 21.

Figure 12:
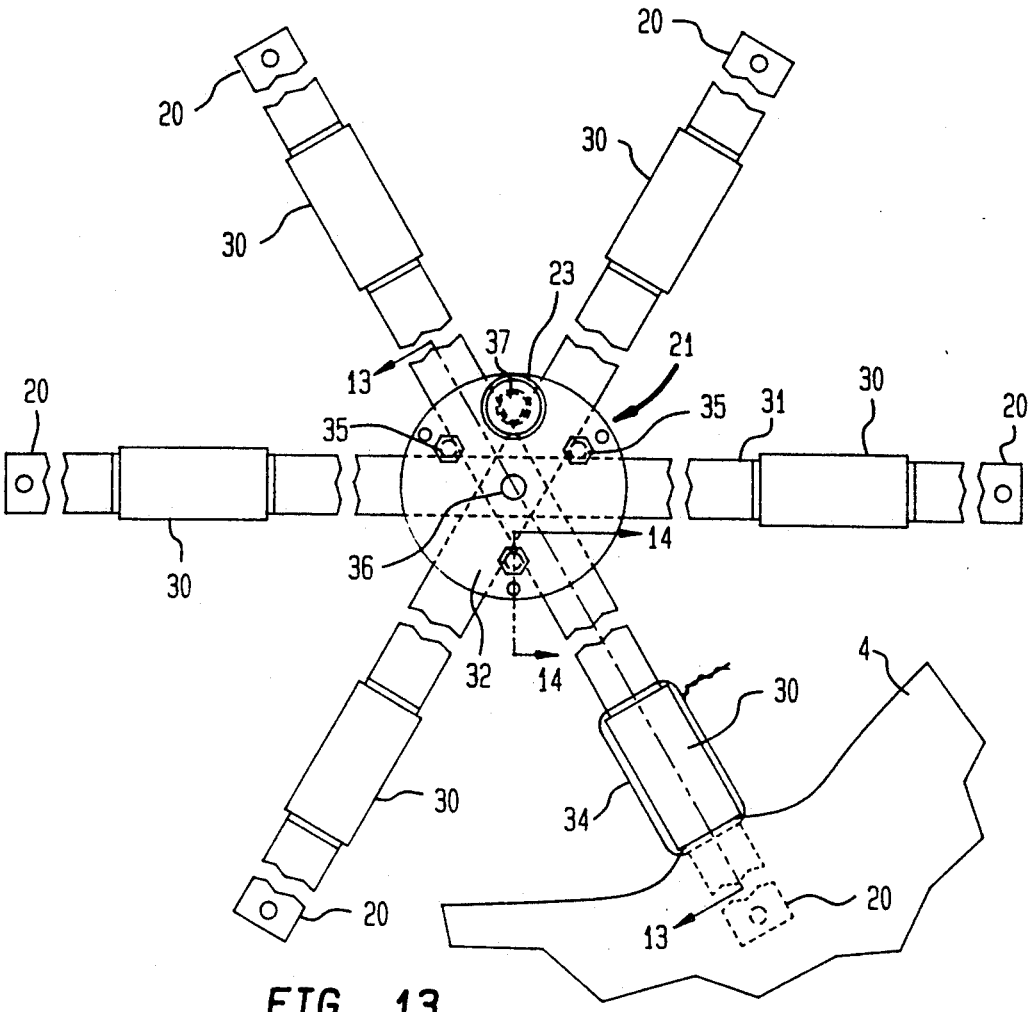
FIG. 12 is a top view of another embodiment of a camouflage device in accordance with the invention, showing in detail the connections of rod structures to a support member.
Figure 13:
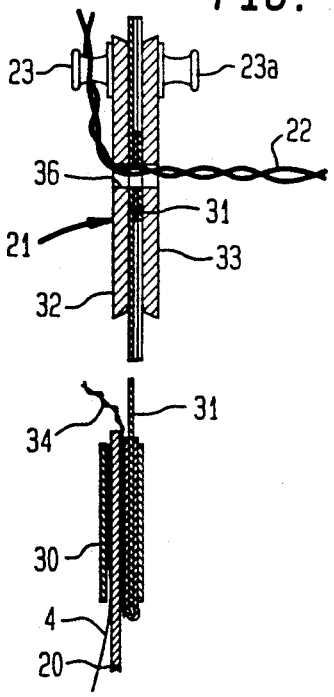
FIG. 13 is a sectional view taken along the line XIII—XIII in FIG. 12.

Turning now to FIGS. 12 and 13, there is shown a top view and a sectional view taken along the line XIII—XIII in FIG. 12 of a preferred embodiment of a camouflage device 60 in accordance with the present invention, including six rod structures or legs 20 to provide an overall star-shaped frame for a netting 4 to be attached thereto. The netting 4 for covering the frame of the camouflage device 60 may be composed of three isosceles triangularly shaped sheets, e.g. of plastic material, which are joined together side-by-side and fixed to a net and is provided with a central opening (not shown) essentially in the size of the crown member 21, with the rim of the netting 4 about the central opening being wrapped around one end of each rod structure 20. This end of each rod structure 20 is received in a hollow sleeve 30 of preferably rectangular cross section while the lower end of the netting 4 is tied to the other end of the rod structures 20 e.g. by bundle wire or the like.

Entering the sleeve 30 from the other side opposite to the rod structure 20 is one end of a spring steel bar 31 which is retained in the crown member 21. As shown in FIG. 12, three spring steel bars 31 are provided for connection with the six rod structures 20 which means that one spring steel bar 31 is used for connection with two opposing rod structures 20. A wire, preferably a steel wire 34, is sandwiched within each sleeve 30 between the coextensive ends of the rod structure 20 and the respective spring steel bar 31 and suitably wound in form of a sling or loop. The ends of the steel wire 34 are twisted together to exert a wedging action between the ends of the rod structure 20 and the spring steel bar 31. In this manner, the rod structure 20 together with the end of the netting 4 and the spring steel bar 31 are squeezed together inside each sleeve 30 to attain a tight fit and to prevent them from becoming loose.

Figure 14:
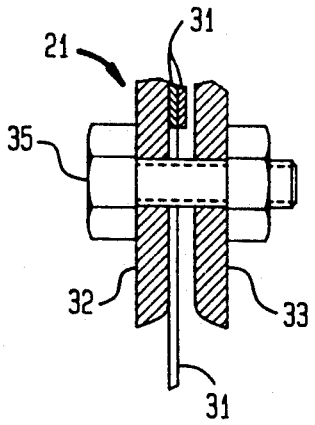
FIG. 14 is a sectional view taken along the line XIV—XIV in FIG. 12.

As best seen in FIG. 13, the crown member 21 includes a pair of spaced aluminum disks 32, 33 between which the three spring steel bars 31 are retained and clamped by screws 35. As shown in particular in FIG. 14, which is a sectional view taken along the line XIV—XIV in FIG. 12, the screws 35 extend through the top disk 32 and are received in suitable threaded bores of the bottom disk 33, with the screws 35 slightly piercing the facing edges of neighboring spring steels 31 (see FIG. 12).

Traversing aligned holes in the disks 32, 33 and in the spring steel bars 31 is a cylindrical hollow bushing 36 which ends flush with the surfaces of the crown member 21, i.e. of the disks 32, 33. The bushing 36 not only provides a throughhole 24 (FIG. 9) in the crown member 21 for passage of the rope 22 which, as previously described, has one end affixed to the object 7 and another end attached to the knob 23, but also prevents an axial displacement of the spring steel bars 31. A screw 37 (FIG. 12) secures the knob 23 to the surface of top disk 32 of the crown member 21. A further knob 23*a* may be secured in a same manner to the bottom disk 33 to allow attachment of the rope 22 when for example the crown member 21 is inverted.

In order to further create a more uneven configuration of the camouflage device 60, the rod structures 20 may be designed of different length.

While the invention has been illustrated and described as embodied in a foldable dummy objects for camouflage purposes, it is not intended to be limited to the details shown since various modifications and structural changes may be made without departing in any way from the spirit of the present invention.

What is claimed as new and desired to be protected by Letters Patent is set forth in the appended claims:

1. A camouflage device adapted to fold and unfold and to assume the shape of a dummy object when in the unfolded configuration for camouflaging an object, comprising:

a frame for supporting a camouflage netting, said frame being adaptable for displaying irregular configuration and including a support member and a plurality of flexible rod structures having one end detachably secured to said support member and another end adapted for placement upon a suitable location of the object to be camouflaged, each of said rod structures being made of an elastic band to allow flexible configuration and random shaping of said frame; and adjustable fastening means connectable to said frame and to the object for exerting a tensile load in direction of the object to be camouflaged and for changing configuration of said frame.

2. A camouflage device as defined in claim 1 wherein said elastic band is made of fiber-reinforced plastic material.

3. A camouflage device as defined in claim 1 wherein said elastic band is made of glass fiber-reinforced epoxy resin.

4. A camouflage device as defined in claim 1 wherein said elastic band is made of steel.

5. A camouflage device as defined in claim 1 wherein said fastening means includes a rope having one end attachable to the object to be camouflaged and selectively securable to said support member for adjusting the length of the rope to take up slack.

6. A camouflage device as defined in claim 5 wherein said support member is provided with a central hole and with an outer knob for allowing passage and attachment of said rope.

7. A camouflage device as defined in claim 5 wherein said rope is comprised of two strands intertwined in a manner to have a number of successive openings for allowing selective attachment of said rope to said support member.

8. A camouflage device as defined in claim 1 wherein each of said rod structures is made of an elastic band and an elastic bar detachably connected to said elastic band in elongation of said elastic bar and attachable to said support member.

9. A camouflage device as defined in claim 8 wherein said elastic bar is a spring steel bar.

10. A camouflage device adapted to fold and unfold and to assume the shape of a dummy object when in the unfolded configuration for camouflaging an object, comprising a frame for supporting a camouflage netting, said frame being adaptable for displaying irregular configuration and including a support member and three pairs of flexible rod structures in star-shaped configuration, each rod structure being provided in form of an elastic band to allow flexible configuration and random shaping of said frame, with each pair of rod structures being linked by an elastic spring steel bar which is detachably secured to said support member, and with the elastic band adapted for placement upon a suitable location of the object to be camouflaged, said camouflage device further comprising fixing means connectable to said frame and to the object for exerting a tensile load in direction of the object to be camouflaged and for changing configuration of said frame.

* * * * *